US009732573B2

(12) United States Patent
Adam

(10) Patent No.: US 9,732,573 B2
(45) Date of Patent: Aug. 15, 2017

(54) DOWNHOLE ACTIVATION ASSEMBLY WITH OFFSET BORE AND METHOD OF USING SAME

(71) Applicant: National Oilwell DHT, L.P., Houston, TX (US)

(72) Inventor: Mark Adam, Aberdeen (GB)

(73) Assignee: National Oilwell DHT, L.P., Houston, TX (US)

( * ) Notice: Subject to any disclaimer, the term of this patent is extended or adjusted under 35 U.S.C. 154(b) by 314 days.

(21) Appl. No.: 14/588,795

(22) Filed: Jan. 2, 2015

(65) Prior Publication Data

US 2015/0191999 A1 Jul. 9, 2015

Related U.S. Application Data

(60) Provisional application No. 61/923,441, filed on Jan. 3, 2014.

(51) Int. Cl.

| | |
|---|---|
| ***E21B 23/00*** | (2006.01) |
| ***E21B 34/14*** | (2006.01) |
| ***E21B 23/04*** | (2006.01) |
| ***E21B 47/12*** | (2012.01) |

(52) U.S. Cl.

CPC ..... *E21B 23/004* (2013.01); *E21B 23/04* (2013.01); *E21B 34/14* (2013.01); *E21B 47/12* (2013.01)

(58) Field of Classification Search

None

See application file for complete search history.

(56) References Cited

U.S. PATENT DOCUMENTS

| | | | | |
|---|---|---|---|---|
| 2,043,352 | A * | 6/1936 | Hulshizer | E21B 6/06 74/127 |
| 2,228,482 | A | 1/1941 | Prebensen | |
| 2,694,551 | A | 11/1954 | Snyder | |
| 3,274,694 | A * | 9/1966 | Hildebrandt | E21B 47/02232 116/230 |
| 3,506,068 | A * | 4/1970 | Brown | E21B 23/08 166/153 |
| 4,712,620 | A | 12/1987 | Lim et al. | |
| 4,905,775 | A * | 3/1990 | Warren | E21B 4/003 137/504 |

(Continued)

FOREIGN PATENT DOCUMENTS

| | | |
|---|---|---|
| GB | 2490376 | 10/2012 |
| WO | 2009135201 | 11/2009 |
| WO | 2012006457 | 1/2012 |

*Primary Examiner* — Shane Bomar

(74) *Attorney, Agent, or Firm* — Conley Rose, P.C.

(57) ABSTRACT

The disclosure relates to a downhole activation assembly for activating a downhole component of a downhole tool positionable in a wellbore penetrating a subterranean formation. The activation assembly includes a housing operatively connectable to the downhole tool, a piston slidably positionable in the housing with a chamber defined therebetween, and a valve. The piston has a flow channel therethrough. The valve is positionable about the flow channel of the piston, the valve comprising a fixed plate and a rotatable plate. The rotatable plate is movable about the fixed plate to define a variable bore to selectively restrict flow through the flow channel and to vary pressure about the piston whereby the piston is selectively moved to shift the downhole component between activation positions.

28 Claims, 9 Drawing Sheets

(56) References Cited

U.S. PATENT DOCUMENTS

| | | | | |
|---|---|---|---|---|
| 5,135,059 | A | 8/1992 | Turner et al. | |
| 5,375,658 | A | 12/1994 | Schultz et al. | |
| 5,810,088 | A | 9/1998 | Lamirand et al. | |
| 5,960,881 | A | 10/1999 | Allamon et al. | |
| 6,330,918 | B1 | 12/2001 | Hosie et al. | |
| 6,761,231 | B1 | 7/2004 | Dock et al. | |
| 7,100,713 | B2 | 9/2006 | Tulloch | |
| 7,252,163 | B2 | 8/2007 | Ollerenshaw et al. | |
| 7,275,592 | B2 * | 10/2007 | Davis | F04C 13/008 166/105.2 |
| 7,308,937 | B2 | 12/2007 | Radford et al. | |
| 7,464,761 | B2 | 12/2008 | Hosatte et al. | |
| 7,469,744 | B2 | 12/2008 | Ruddock et al. | |
| 7,503,392 | B2 | 3/2009 | King et al. | |
| 7,510,001 | B2 | 3/2009 | Spring et al. | |
| 7,628,213 | B2 | 12/2009 | Telfer | |
| 7,635,029 | B2 | 12/2009 | MacDougall et al. | |
| 7,665,545 | B2 | 2/2010 | Telfer | |
| 7,673,708 | B2 | 3/2010 | Lee | |
| 7,681,650 | B2 | 3/2010 | Telfer et al. | |
| 7,766,084 | B2 | 8/2010 | Churchill | |
| 7,823,663 | B2 | 11/2010 | Eddison | |
| 8,020,626 | B2 | 9/2011 | Francis et al. | |
| 8,074,747 | B2 | 12/2011 | Radford et al. | |
| 8,157,018 | B2 | 4/2012 | Francis et al. | |
| 8,167,051 | B2 | 5/2012 | Eddison et al. | |
| 8,181,722 | B2 | 5/2012 | Radford et al. | |
| 8,215,418 | B2 | 7/2012 | Radford | |
| 8,230,951 | B2 | 7/2012 | Radford et al. | |
| 8,281,856 | B2 | 10/2012 | Jahn et al. | |
| 8,297,347 | B2 | 10/2012 | Ruark et al. | |
| 8,347,972 | B2 | 1/2013 | Francis et al. | |
| 9,045,958 | B2 | 6/2015 | Eddison | |
| 2002/0185312 | A1 | 12/2002 | Armell et al. | |
| 2005/0274525 | A1 * | 12/2005 | Stevens | E21B 21/10 166/332.1 |
| 2008/0128169 | A1 | 6/2008 | Radford et al. | |
| 2008/0128174 | A1 | 6/2008 | Radford et al. | |
| 2008/0128175 | A1 | 6/2008 | Radford et al. | |
| 2008/0236841 | A1 | 10/2008 | Howlett et al. | |
| 2010/0212969 | A1 | 8/2010 | Radford et al. | |
| 2010/0212970 | A1 | 8/2010 | Radford et al. | |
| 2011/0031020 | A1 | 2/2011 | Cote | |
| 2011/0073376 | A1 | 3/2011 | Radford et al. | |
| 2011/0127044 | A1 | 6/2011 | Radford et al. | |
| 2011/0192607 | A1 | 8/2011 | Hofman et al. | |
| 2012/0080183 | A1 | 4/2012 | Radford et al. | |
| 2012/0080228 | A1 | 4/2012 | Radford et al. | |
| 2012/0111579 | A1 | 5/2012 | Radford et al. | |
| 2013/0043022 | A1 | 2/2013 | Forster | |
| 2014/0041943 | A1 | 2/2014 | Lanning et al. | |
| 2015/0034387 | A1 | 2/2015 | Malcolm et al. | |

* cited by examiner

DOWNHOLE ACTIVATION ASSEMBLY WITH OFFSET BORE AND METHOD OF USING SAME

CROSS-REFERENCE TO RELATED APPLICATIONS

Applicant filed U.S. Provisional Application No. 61/923,441 on Jan. 3, 2014, the entire contents of which are hereby incorporated by reference herein.

BACKGROUND

The present disclosure relates generally to techniques for performing wellsite operations. More specifically, the present disclosure relates to downhole devices, such as activators or activation assemblies, for use with downhole tools.

Oilfield operations may be performed to locate and gather valuable downhole fluids. Oil rigs are positioned at wellsites, and downhole equipment, such as drilling tools, are deployed into the ground by a drill string to reach subsurface reservoirs. At the surface, an oil rig is provided to deploy stands of pipe into the wellbore to form the drill string. Various surface equipment, such as a top drive, or a Kelly and a rotating table, may be used to apply torque to the stands of pipe, threadedly connect the stands of pipe together, and rotate the drill string. A drill bit is mounted on the lower end of the drill string, and advanced into the earth by the surface equipment to form a wellbore.

The drill string may be provided with various downhole components, such as a bottom hole assembly (BHA), drilling motor, measurement while drilling, logging while drilling, telemetry, reaming and/or other downhole tools, to perform various downhole operations. The downhole tool may be provided with devices for activation of downhole components. Examples of downhole tools are provided in U.S. Pat. Nos. 6,615,933, 7,703,553, 7,823,663, Application Nos. 20120055714, 20130192897, and 20100252276, the entire contents of which are hereby incorporated by reference herein.

SUMMARY

In at least one aspect, the disclosure relates to a downhole activation assembly for activating a downhole component of a downhole tool positionable in a wellbore penetrating a subterranean formation. The activation assembly includes a housing operatively connectable to the downhole tool, a piston slidably positionable in the housing with a chamber defined therebetween, and a valve. The piston has a flow channel therethrough. The valve is positionable about the flow channel of the piston, the valve comprising a fixed plate and a rotatable plate. The rotatable plate is movable about the fixed plate to define a variable bore to selectively restrict flow through the flow channel and to vary pressure about the piston whereby the piston is selectively moved to shift the downhole component between activation positions.

The fixed plate may have a fixed offset bore. The rotatable plate may have a movable offset bore positionable relative to the fixed offset bore. The variable bore may define a variable cross-sectional flow area. The fixed plate may have a funnel shape, and the rotatable plate an inverted funnel shape. The piston may include an uphole portion and a downhole portion with the valve therebetween.

The activation assembly may also include a spring loaded indexing sleeve operatively connecting the piston to the downhole component. The sleeve may have ports therethrough to permit passage of fluid between the flow channel and the chamber. The activation assembly may also include a sensor to detect an activation signal, and/or a signal source deployable into the activation assembly to send the activation signal. The activation signal may include a change in flow of the fluid. The activation assembly may also include a motor to selectively move the rotatable plate, and/or a sensor to activate the motor upon detection of an activation signal. The activation assembly may also include centralizers positionable about the housing.

In another aspect, the disclosure relates to a downhole tool positionable in a wellbore penetrating a subterranean formation. The downhole tool includes a conveyance, a bottom hole assembly deployable into the wellbore by the conveyance, and a downhole activation assembly for activating the downhole component. The bottom hole assembly carries a downhole component. The activation assembly is positionable about the bottom hole assembly. The activation assembly includes a housing operatively connectable to the bottom hole assembly, a piston slidably positionable in the housing with a chamber defined therebetween, and a valve. The piston has a flow channel therethrough. The valve is positionable about the flow channel of the piston, the valve comprising a fixed plate and a rotatable plate. The rotatable plate is movable about the fixed plate to define a variable bore to selectively restrict flow through the flow channel and to vary pressure about the piston whereby the piston is selectively moved to shift the downhole component between activation positions.

The conveyance may be a drill string fluidly connectable to a mud pit to pass fluid through the activation assembly. The downhole tool may also include a pump to selectively pass the fluid from the mud pit to the activation assembly, and/or a transducer to measure pressure of the fluid. The downhole component includes at least one of an indexer, a stabilizer, and a reamer. The downhole tool may also include a surface controller. The bottom hole assembly may also include a downhole controller.

Finally, in another aspect, the disclosure relates to a method of activating a downhole component of a downhole tool positionable in a wellbore penetrating a subterranean formation. The method involves deploying the downhole component and an activation assembly into the wellbore via the downhole tool. The activation assembly includes a piston having a flow channel therethrough and a valve positionable about the flow channel. The valve includes a fixed plate and a rotatable plate. The method further involves selectively shifting the downhole component between activation positions with the piston by moving the rotatable plate about the fixed plate to selectively restrict flow through the flow channel and to vary pressure about the piston.

The may also involve sending an activation signal to move the rotatable plate, and/or sensing the activation signal. The sending may involve selectively adjusting flow rate through the flow channel. The method may also involve deploying a signal source into the activation assembly and performing the selectively shifting upon sensing the activation signal. The selectively shifting may also involve axially moving the piston to index an indexer, and/or increasing pressure about the piston to generate sufficient force to overcome a spring force of the indexer and ratchet between indexer positions.

BRIEF DESCRIPTION OF THE DRAWINGS

The appended drawings illustrate example embodiments and are, therefore, not to be considered limiting in scope.

The figures are not necessarily to scale and certain features, and certain views of the figures may be shown exaggerated in scale or in schematic in the interest of clarity and conciseness.

DETAILED DESCRIPTION

The description that follows includes exemplary apparatus, methods, techniques, and/or instruction sequences that embody aspects of the present subject matter. However, it is understood that the described embodiments may be practiced without these specific details.

The present disclosure relates to an activation assembly for remotely activating a downhole tool, such as a reamer, from the surface. The activation assembly (or stroking mechanism or stroker) is a hydraulic switch that may be activated by a surface signal (or trigger) to provide unlimited cycling of the downhole tool between various positions. The activation assembly includes a piston with plates defining a variable offset bore therethrough, a piston motor to move the plates, electronics to activate the motor, and an indexer. A signal from the surface may be used to activate the motor to rotate the plates and adjust flow therethrough. The plates may be rotated to selectively buildup pressure to activate the indexer, and thereby the downhole tool.

The activation assembly is configured with a variable (or configurable) total flow area (TFA) to allow or prevent sufficient pressure buildup to stroke the activation assembly to activate the downhole tool.

Figure 1:
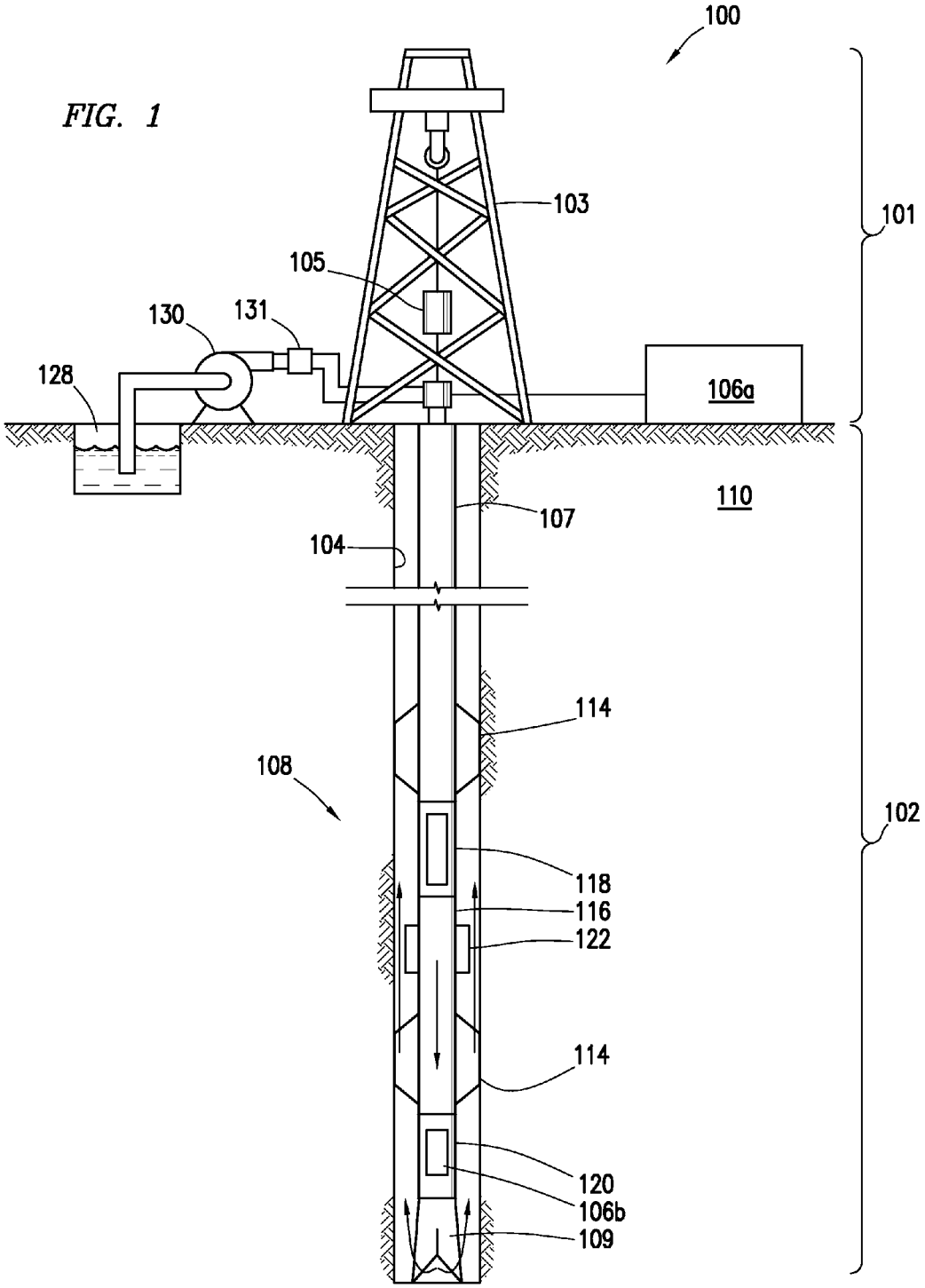
FIG. 1 depicts a schematic view, partially in cross-section of a wellsite having surface equipment and downhole equipment, the downhole equipment including a downhole activation assembly and a downhole tool.

FIG. 1 depicts a schematic view, partially in cross-section, of a wellsite 100. While a land-based drilling rig with a specific configuration is depicted, the present disclosure may involve a variety of land based or offshore applications. The wellsite 100 includes surface equipment 101 and downhole equipment 102. The surface equipment 101 includes a rig 103 positionable at a wellbore 104 for performing various wellbore operations, such as drilling.

Various rig equipment 105, such as a Kelly, rotary table, top drive, elevator, etc., may be provided at the rig 103 to operate the downhole equipment 102. A surface controller 106*a* is also provided at the surface to operate the downhole equipment 102.

The downhole equipment 102 includes a drill string 107 with a bottom hole assembly (BHA) 108 and a drill bit 109 at an end thereof. The downhole equipment 102 is advanced into a subterranean formation 110 to form the wellbore 104. The drill string 107 may include drill pipe, drill collars, coiled tubing, or other tubing used in drilling operations. Downhole equipment, such as the BHA 108, is deployed from the surface and into the wellbore 104 by the drill string 107 to perform downhole operations.

The BHA 108 is at a lower end of the drill string 107 and contains various downhole equipment for performing downhole operations. As shown, the BHA 108 includes stabilizers 114, a reamer 116, an activation assembly 118, a measurement while drilling tool 120, cutter blocks 122, and a downhole controller 106*b*. While the downhole equipment 102 is depicted as having a reamer 116 for use with the activation assembly 118, a variety of downhole tools may be activated by the activation assembly 118. For example, the downhole tool may be any downhole component and/or mechanism, such as a reamer (e.g., multi cycle under reamer), variable gauge stabilizer, circulating sub tools, etc. The downhole equipment 102 may also include various other equipment, such as logging while drilling, telemetry, processors and/or other downhole tools.

The stabilizers 114 may be conventional stabilizers positionable about an outer surface of the BHA 108. The reamer 116 may be an expandable reamer with the cutter blocks 122 extendable therefrom. The activation assembly 118 may be integral with or operatively coupled to the reamer 116 or other downhole tools for activation thereof as will be described further herein. For example, the activation assembly 118 may be used with an expandable reamer 116 to alternatively prevent and permit expansion of the cutter blocks 122 under flow of drilling fluid through the reamer 116. The activation assembly 118 may be used alone or in conjunction with other activation devices, such as a ball drop type switching mechanism, to activate various downhole tools.

The downhole controller 106*b* provides communication between the BHA 108 and the surface controller 106*a* for the passage of power, data and/or other signals. One or more controllers 106*a,b* may be provided about the wellsite 100.

A mud pit 128 may be provided as part of the surface equipment for passing mud from the surface equipment 101 and through the downhole equipment 102, the BHA 108 and the bit 109 as indicated by the arrows. Various flow devices, such as pump 130 may be used to manipulate the flow of mud about the wellsite 100. Flow rate of the mud pumped by the pump 130 may be measured by a transducer 131. Various tools in the BHA 108, such as the reamer 116 and the activation assembly 118, may be activated by fluid flow from the mud pit 128 and through the drill string 107.

Figure 2:
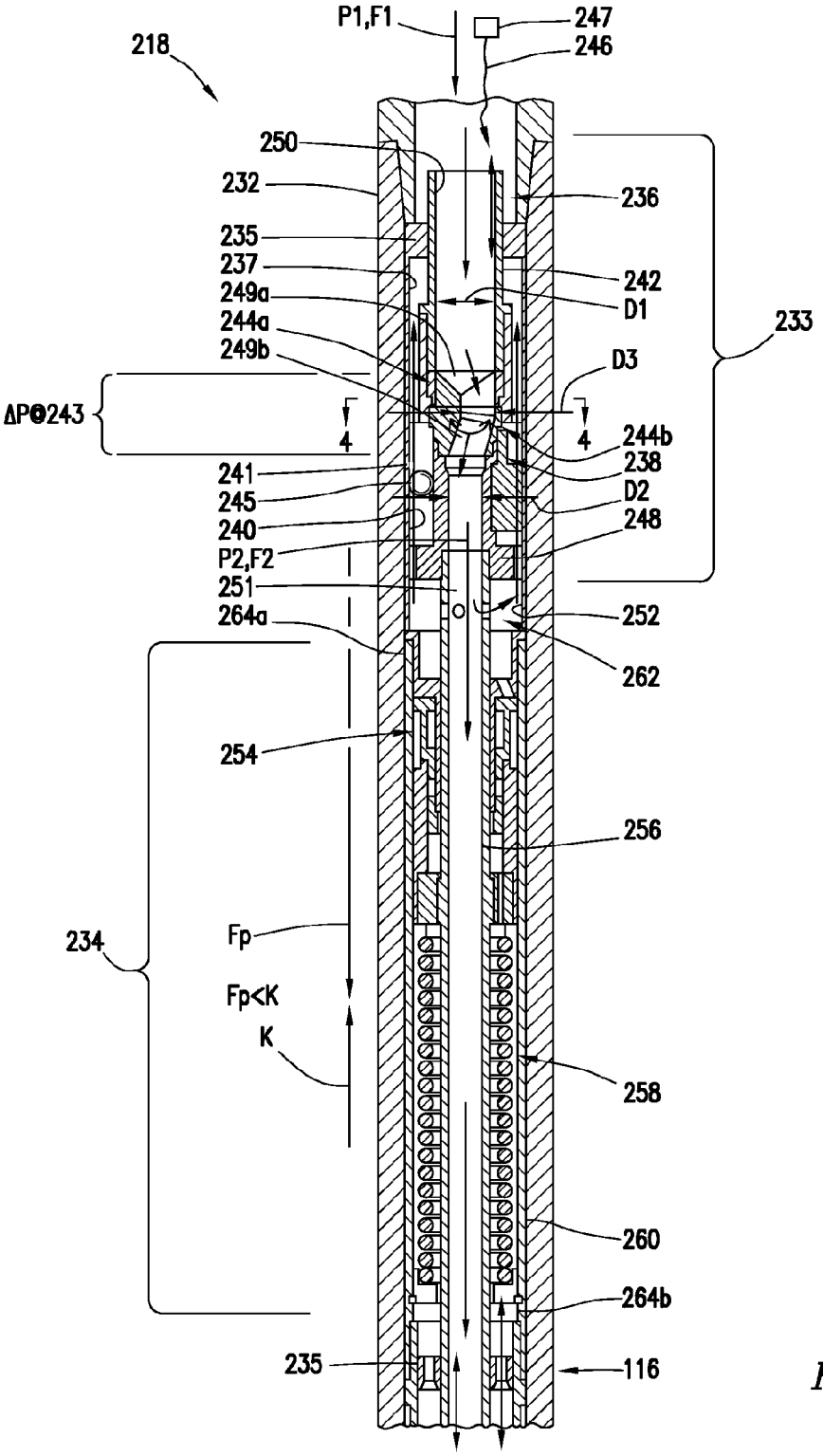
FIG. 2 depicts a longitudinal, cross-sectional view of a downhole activation assembly having a piston valve including fixed and rotatable plates for defining a variable flow bore.

FIG. 2 depicts an activation assembly 218 usable for activating one or more downhole tools, such as the reamer 116. The activation assembly 218 includes an activation housing 232, an actuator 233, and an indexer 234. The actuator 233 may be operatively connected to the indexer 234. The indexer 234 may be coupled to the downhole tool 116 for activation thereof.

The activation housing 232 may be one or more drill collars or other tubulars capable of slidingly receiving the actuator 233, indexer 234 and/or other components, and passing fluid (e.g., drilling mud) therethrough. The activation housing 232 may be provided with supports, such as centralizer 235, for supporting the actuator 233, indexer 234 and/or other components therein.

The actuator 233 includes a piston 236, a piston motor 238, electronics 240, a piston housing 241, and an indexing tube 256. The piston 236 is positionable in the piston housing 241. The piston housing 241 slidably supports the piston 236 in the activation housing 232. The piston 236 includes an uphole portion 242, a piston valve 243, and a downhole portion 248. The piston 236 has a bore 250 therethrough made variable by movement of the piston valve 243. The piston valve 243 acts as a flow controller for selectively activating the activation assembly 218 to move between positions.

The uphole portion 242 of the piston 236 is a tubular member supported at an uphole end of the piston housing 241. The downhole portion 248 is a flange shaped member supported at a downhole end of the piston housing 241. The piston valve 243 includes a pair of plates 244*a,b* positionable in the piston housing 241 between the uphole portion 242 and the downhole portion 248.

The pair of plates 244*a, b* each have an offset bore 249*a,b*, respectively, therethrough. The pair of plates 244*a, b* includes a fixed plate 244*a* adjacent the uphole portion 242 and a rotatable downhole plate 244*b* adjacent the downhole portion 248. The piston housing 241 has a shoulder to fixedly support the uphole plate 244*a* and to rotatably support the downhole plate 244*b* therein.

One or both of the plates 244*a,b* may rotate within the piston housing 241 to selectively align the offset bores 249*a,b* extending therethrough. The flow through the bore 250 of piston 236 may be selectively manipulated by adjusting the offset bores 249*a,b*. The bore 250 has a diameter D1 along the uphole portion 242, and a diameter D2 at the downhole portion 248.

The bore 250 also has a variable diameter D3 defined between the fixed plate 244*a* and the rotatable plate 244*b*. The fixed plate 244*a* has fixed bore 249*a* that tapers from the diameter D1 of the uphole portion to the offset bore 249*b*. The offset bore 249*b* tapers from the fixed bore 249*a* to the diameter D2 of the downhole portion. The variable diameter D3 selectively adjusts as the rotatable plate 244*b* rotates with respect to the fixed plate 244*a*.

FIGS. 2, and 3A-4B depict various views of the plates 244*a,b*. These views show the flow path defined by the variable bores 249*a,b* of the plates 244*a,b*. As depicted by these figures, the plates 244*a,b* are selectively alignable to manipulate flow through the activation assembly 218.

Figure 3A:
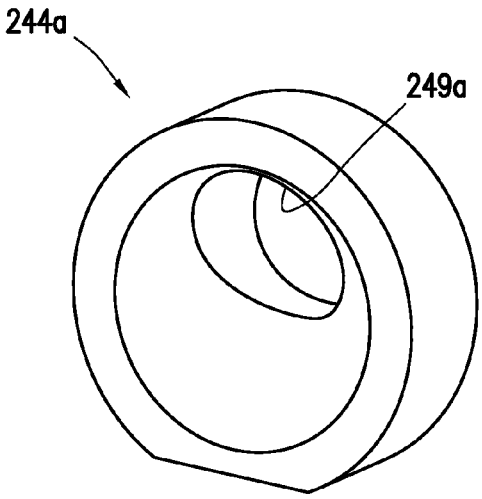
FIGS. 3A-3B depict perspective views of the fixed and rotatable plates, respectively.
Figure 3B:
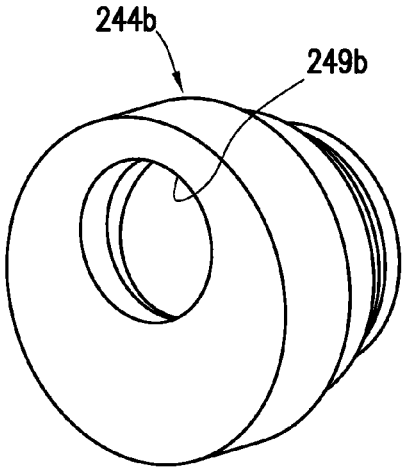

FIGS. 3A and 3B show the fixed plate 244*a* and the rotatable plate 244*b*, respectively. The fixed and rotatable plates 244*a,b* are tubular members with an outer surface defined to engage the piston housing 241. The fixed plate 244*a* has an offset funnel shaped bore 249*a* to pass fluid from the uphole portion 242 to offset bore 249*b* of the rotatable plate 244*b*. The rotatable plate 244*b* has an inverted offset funnel shaped bore 249*b* to pass fluid from the fixed plate 244*a* to the downhole portion 248.

Figure 4A:
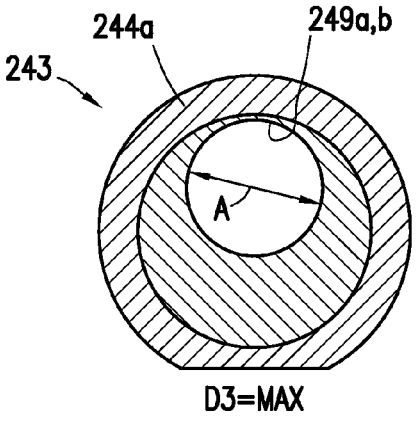
FIGS. 4A-4B depict radial cross-sectional views of the piston valve of FIG. 2 taken along lines 4-4 in a first and a second position, respectively.
Figure 4B:
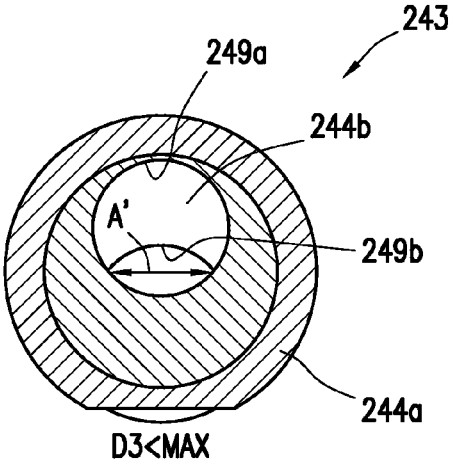

FIGS. 4A and 4B show cross-sectional views of the valve 243 of FIG. 2 taken along line 4-4. FIG. 4A shows the plates 244*a,b* in an aligned position defining a variable flow area A therethrough. In the aligned position of FIG. 4A, the bores 249*a,b* are positioned to provide a large flow area A and a large diameter D3 (FIG. 2) to maximize the amount of flow therethrough.

FIG. 4B shows the movable plate 244*b* rotated to a non-aligned (or offset) position defining a variable flow area A'. The offset bore 249*b* is offset such that upon rotation of the rotatable plate 244*b*, the diameter D3 (FIG. 2) between the fixed bore 249*a* and the offset bore 249*b* varies. The flow area A' is reduced as the diameter D3 is reduced. This variable diameter selectively restricts flow through the piston bore 250 and alters the pressure and flow therethrough.

Referring back to FIG. 2, the piston motor 238 and electronics 240 are positionable in a cavity 237 defined between the piston housing 241 and the piston 236. The electronics 240 may be electrically coupled to the surface for receiving signals (e.g., power, communication, etc.) therefrom. The electronics 240 may be part of, or coupled to the, downhole controller (106*b* of FIG. 1) and include electrical components, such as a sensor 245 and other electronics (e.g., batteries, receivers, hardware, software, and/or other devices) used for operating the piston motor 238.

The sensor 245 may be, for example, a receiver positioned about the activation assembly 218 for reading a signal 246 from a surface or other location. The signal 246 may be an electrical, magnetic or other signal provided from a signal source 247. In an example, the signal source 247 may be a radio-frequency identification (RFID) tag dropped into the activation assembly 218 as shown in FIG. 2. In another example, the signal source 247 may be hard wired drill pipe (e.g., INTELLISERV™ commercially available at www.nov.com) operatively coupled to the electronics 240 for passing the signal 246 to the sensor 245. Other means of generating the signal 246 receivable by the sensor 245 may also be provided.

The piston motor 238 may be coupled to the electronics 240 for receiving power and/or communication signals therefrom. The piston motor 238 may be used to selectively move portions of the activation assembly 218, such as the rotating plate 244*b*. In an example, the piston motor 238 may be a rotary motor capable of rotating the plates 244*a,b*. The piston motor 238 may be activated by the signal 246 detectable by the sensor 245. The electronics 240 may communicate the sensed signal 246 to the piston motor 238 to activate the piston motor 238 to rotate the rotating plate 244*b*.

The piston motor 238 may be any motor (e.g., electrical, hydraulic, etc.) capable of moving the rotatable plate 244*b* between various positions to selectively adjust the variable bore 249*a,b* therethrough. The position of the plates 244*a,b* and the bore 249*a,b* therethrough may be used to selectively adjust pressure passing through the activation assembly 218. The variable pressure may be used to activate the downhole tool 116.

The indexing tube 256 is operatively connected to a downhole end of the downhole portion 248, and is slidably receivable by the indexer 234. The indexing tube 256 has an index bore 251 therethrough, and plurality of ports 262 through an upper end thereof. An index cavity 252 is defined between the indexer 234 and the actuator 233. The index cavity 252 is in fluid communication with the piston cavity 237.

Fluid passes through the variable bore 250 into the index bore 251. A portion of the fluid passes through the ports 262 and into the index cavity 252 and the piston cavity 237. The pressure ports 262 communicate differential pressure to the piston 236. Fluid passing into the piston cavity 237 may apply pressure to urge the actuator 233 downhole towards the indexer 234. Pressure is generated in the piston cavity 237 which drives the actuator 233 and the indexing tube 254 downhole.

A pressure differential $\Delta P$ is provided across the piston valve 243. Fluid flows into the activation assembly 218 at a pressure P1 and a flow rate F1. A second pressure P2 is generated below the valve 243. The pressure ports 262 are positioned below the piston valve 243 and communicate pressure differential across the piston valve 243 to the piston 236. This pressure differential may be used to activate the indexer 234 to active the downhole tool 116.

The indexer 234 may be any indexer capable of receiving the indexing tube 256, shifting in response to pressure across the piston, and activating the downhole tool 116. Examples of indexers that may be used are provided in US Patent/Application No. 20100252276 and/or the FLOW ACTIVATED HYDRAULIC JETTING INDEXING TOOL™ commercially available at www.nov.com. The indexer as shown includes a ratchet 254, a spring 258, and an indexing sleeve 260. The indexing sleeve 260 is positioned along an inner surface of the activation housing 232. The indexing sleeve 260 has an uphole end 264*a* and a downhole end 264*b*. The ratchet 254 is positioned between the indexing tube 256 and the indexing sleeve 260 adjacent the uphole end 264*a* of the indexing sleeve 260. The ratchet 254 includes a plurality of slots interlockingly engageable with tabs on the indexing tube 256 to selectively shift the indexer between positions.

The spring 258 is positioned between a shoulder of the indexing tube 256 and the downhole end 264*b* of the indexing sleeve 260. The spring 258 has a spring force K that may be compressed upon application of sufficient force to overcome the spring force of the spring 258. The actuator 233 may be used to generate the piston force Fp using pressure differentials across valve 243 to overcome the force K of the spring 258 and shift the indexer 234.

The pressure differential ΔP is used to apply a piston force Fp against the indexer 234. The piston 236 is directed to oppose the indexer 234. Positioning of the valve 243 and adjustment of the flow rate at the surface may be used to vary the differential pressure. Sufficient pressure may be used to generate a sufficient piston force Fp to overcome the spring force K of the spring 258. A pressure signal is generated each time the indexer 234 cycles, thereby giving surface indication that indexer 234 has switched position. This pressure signal may be detectable by the surface and/or downhole controllers (e.g., 106*a,b* of FIG. 1) and/or by the electronics 240.

Compression of the spring 258 causes the indexer 234, as well as the actuator 233 connected thereto, to move to a downhole position. The indexer 234 (and the actuator 233) returns to an uphole position upon removal of force from the spring 258.

FIGS. 5A-5E show the activation assembly 218 in various stages of operation in an activation sequence. As demonstrated by these figures, signal source 247 is deployed and, when the signal 246 is detected by the sensor 245, the valve 243 is partially closed, and the pressure differential ΔP develops across the piston 236 due drilling fluid flow. The pressure differential ΔP moves the piston 236 and also produces a characteristic pressure response in the drilling fluid pumped at surface. The valve 243 is automatically reopened, for example, after the sensor 245 detects an end of stroke of the piston 236. The reopening also produces a characteristic pressure response at the surface.

Figure 5A:
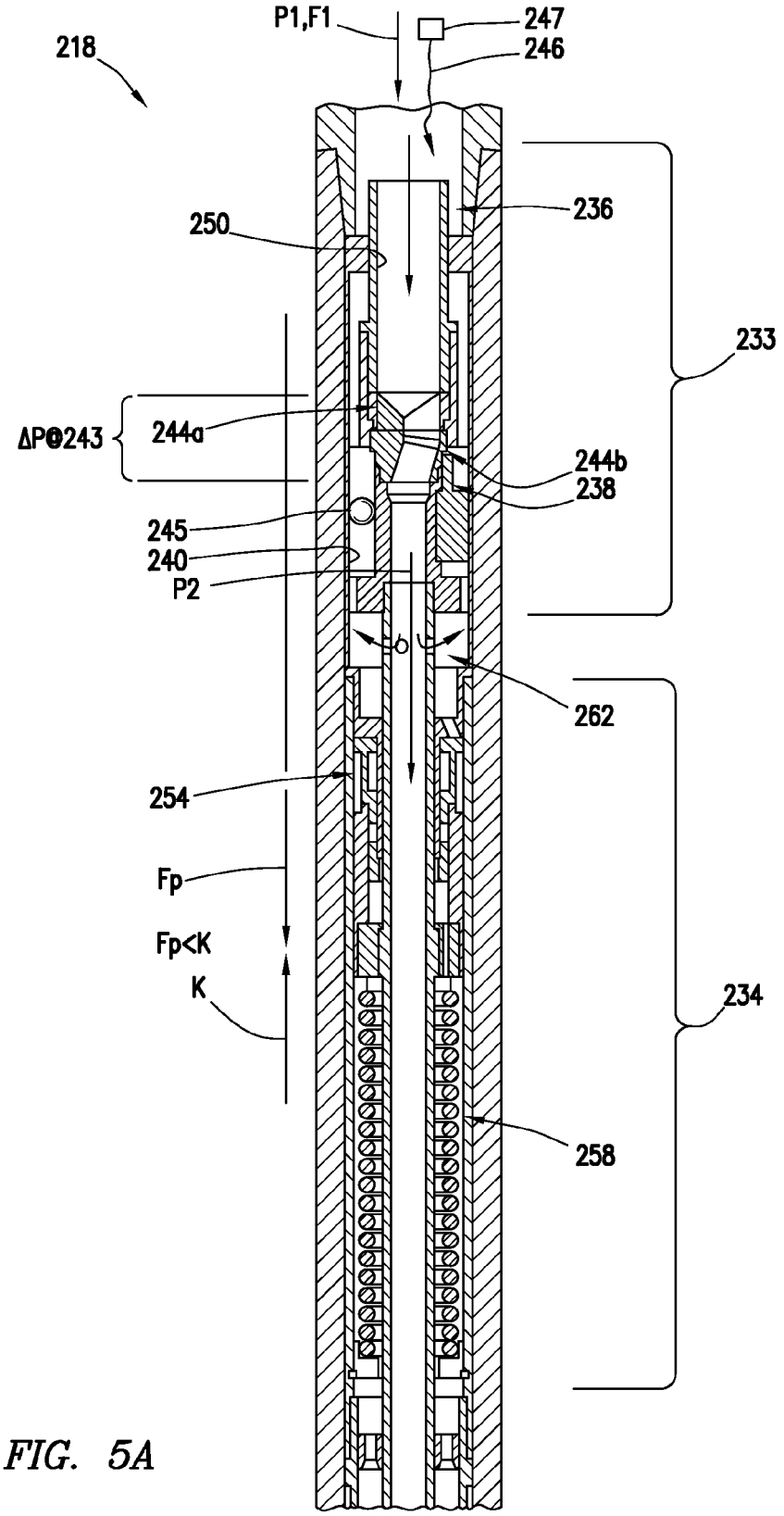
FIGS. 5A-5E depict longitudinal, cross-sectional views of the downhole activation assembly of FIG. 2 in various positions.

FIG. 5A shows the activation assembly 218 in a pre-actuation (or dormant) position at an initial stage of an activation sequence. The fixed and rotatable plates 249*a,b* are aligned for maximum flow therethrough as shown in FIG. 4A. Fluid flows from the mud pit (128 of FIG. 1) at a flow rate of F1 into the activation assembly 218. The large through bore 250 allows drilling fluid to pass through the valve 243, at increased flow rates, while creating a minimal pressure differential across the piston 236.

Due to, the minimal pressure differential ΔP between the surface pressure P1 and the valve pressure P2, the force generated by the pressure across the piston 236 (Fp) is less than a force K of the spring 258 of the indexer 234. As shown, the force K of the spring 258 urges the spring 258 uphole against the actuator 233. Thus, the actuator 233 is retained in its existing position.

The indexer 234 remains in this non-activated position until the sensor 245 receives the signal 246 to initiate a switching sequence. The signal 246 is deployed into the bore 250 and detected by the sensor 245. Upon detection of the signal 246, the electronics 240 then communicate with the motor 238 to initiate rotation of the plates 244*a, b*.

Figure 5B:
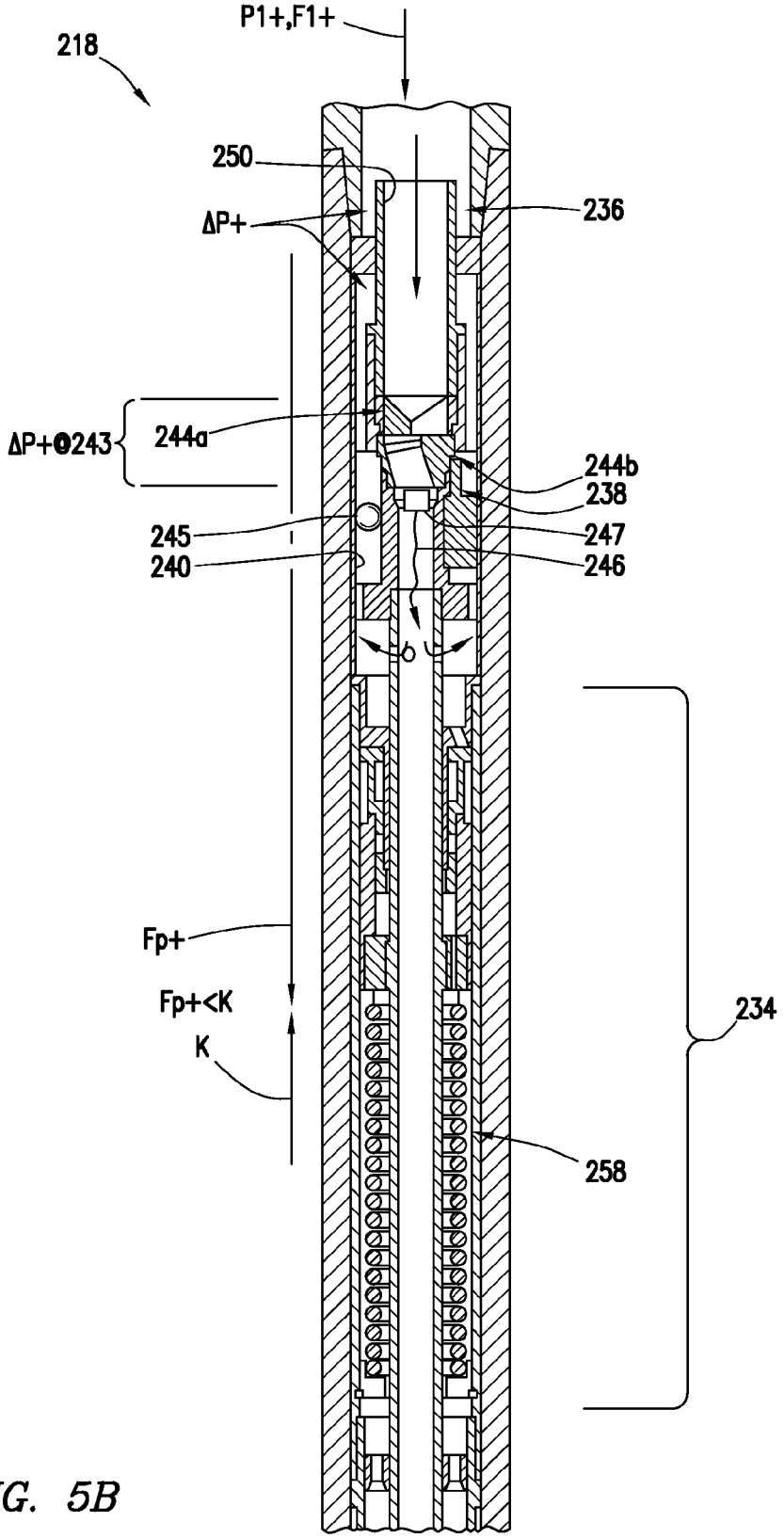

FIG. 5B shows the activation assembly 218 in an initiated position of the activation sequence. The motor 238 is activated by the electronics 240 to rotate the rotatable plate 244*b* to an offset position in non-alignment with the fixed plate 244*a* as shown in FIG. 4B. In the non-aligned position, flow area A' (FIG. 4B) through the bore 250 is reduced and the uphole pressure P1 increases to P1+ uphole from the piston valve 243. The pressure differential ΔP across the valve 243 also increases to ΔP+. Optionally, additional pressure changes may be provided to index to various positions.

The increased pressure differential ΔP+ across the piston valve 243 increases the piston force Fp acting against the indexer 234 to Fp+. The increase in pressure P1+ is detectable at the surface (e.g., by an increase in surface stand pipe pressure), indicating to the surface controller 106*a* that a switching sequence has initiated. As depicted in FIG. 5B, the increase in pressure differential ΔP+ is insufficient to increase the piston force Fp to Fp+ that can overcome the spring force K of the index spring 258.

Figure 5C:
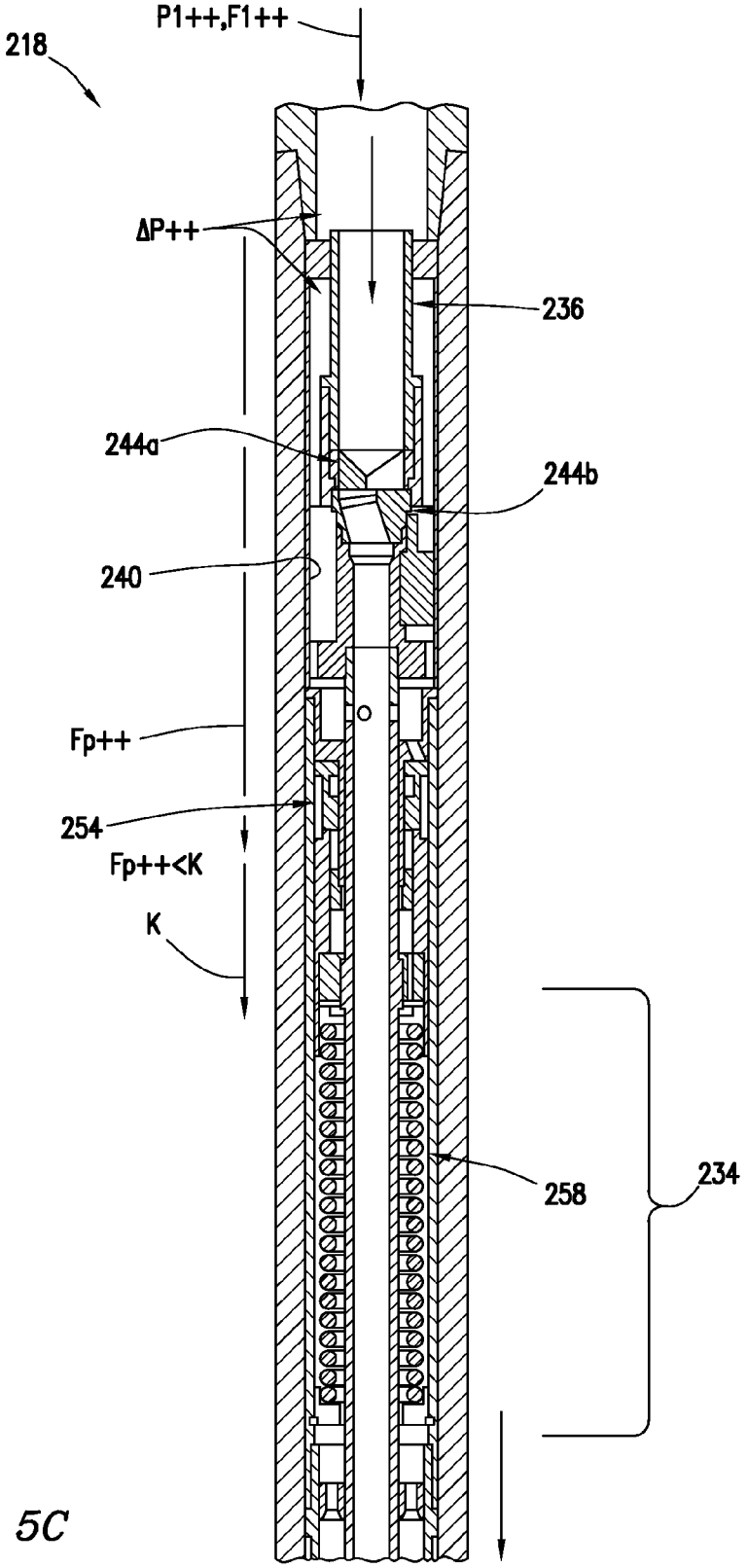

FIG. 5C shows the activation assembly 218 in an 'activated' position further along the activation sequence. The pressure differential ΔP+ has increased further to ΔP++. This increase may be made, for example, by increasing the flow rate F1++ at the surface using the pump 130 (FIG. 1). The increase in flow rate F1++ also increases the pressure P1++ and the differential ΔP++. This increase also increases the piston force Fp+ to Fp++ sufficient to overcome the spring force K and compress the spring 258. The compression of the spring activates the ratchet 254 to shift the indexer 234 to the next position. The electronics 240 and/or controllers 106*a,b* (FIG. 1) may detect movement of the indexer 234 and/or changes in pressure to detect shifting of the indexer 234.

Figure 5D:
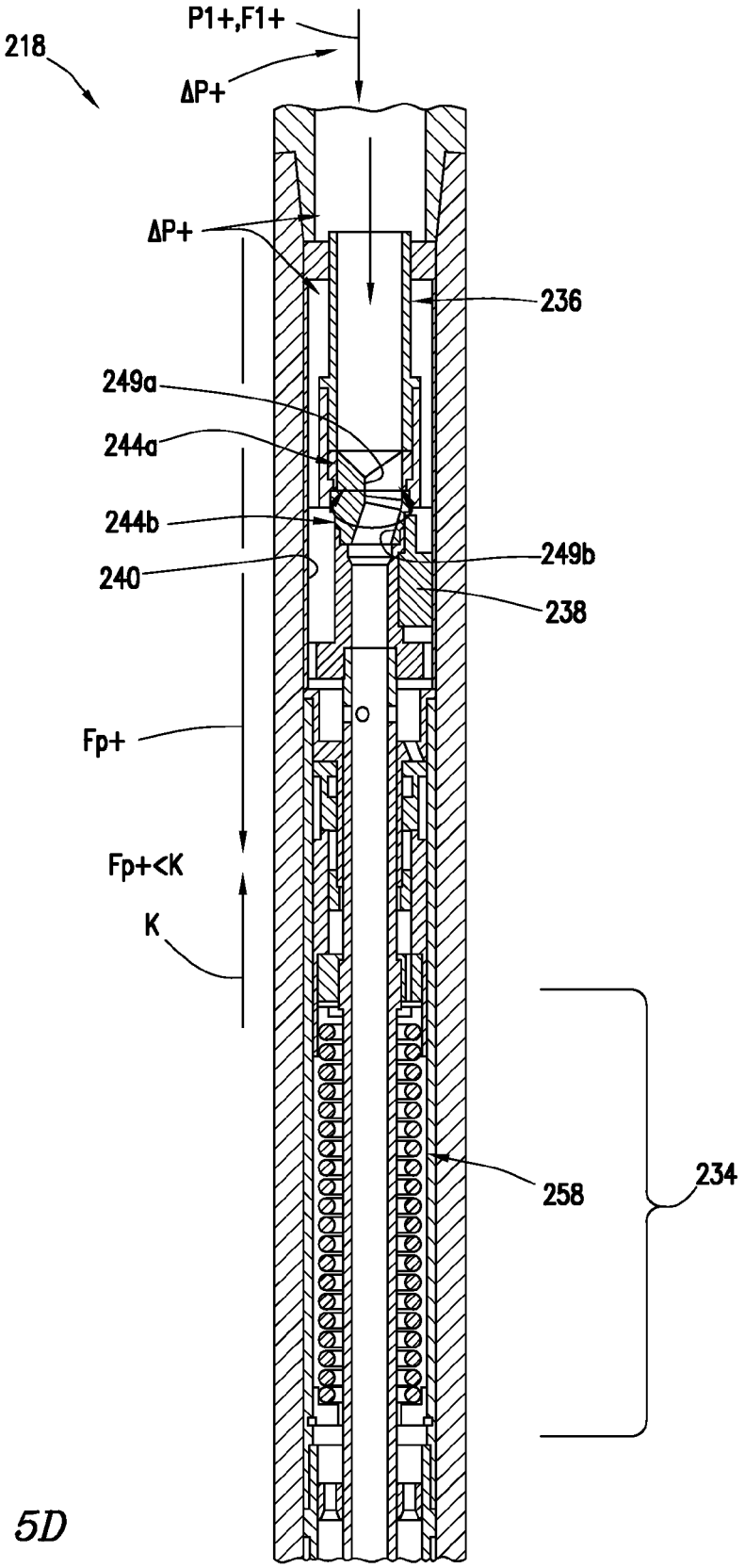

FIG. 5D shows the activation assembly 218 in an 'indexed position' further yet along the activation sequence. The indexer 234 is driven downhole and the stroke limit of the piston 236 is reached. The electronics 240 has detected the completion of activation of the indexer 234 (and thereby the downhole tool 116) and activates the motor 238 to return the rotatable plate 244*b* to its original position in alignment with plate 244*a*. The offset bores 249*a,b* are re-aligned to the position of FIG. 4A to maximize flow therethrough. Pressure differential ΔP++, piston force Fp++, and pressure to P++ reduced to ΔP+, Fp+, and P1+, respectively.

Figure 5E:
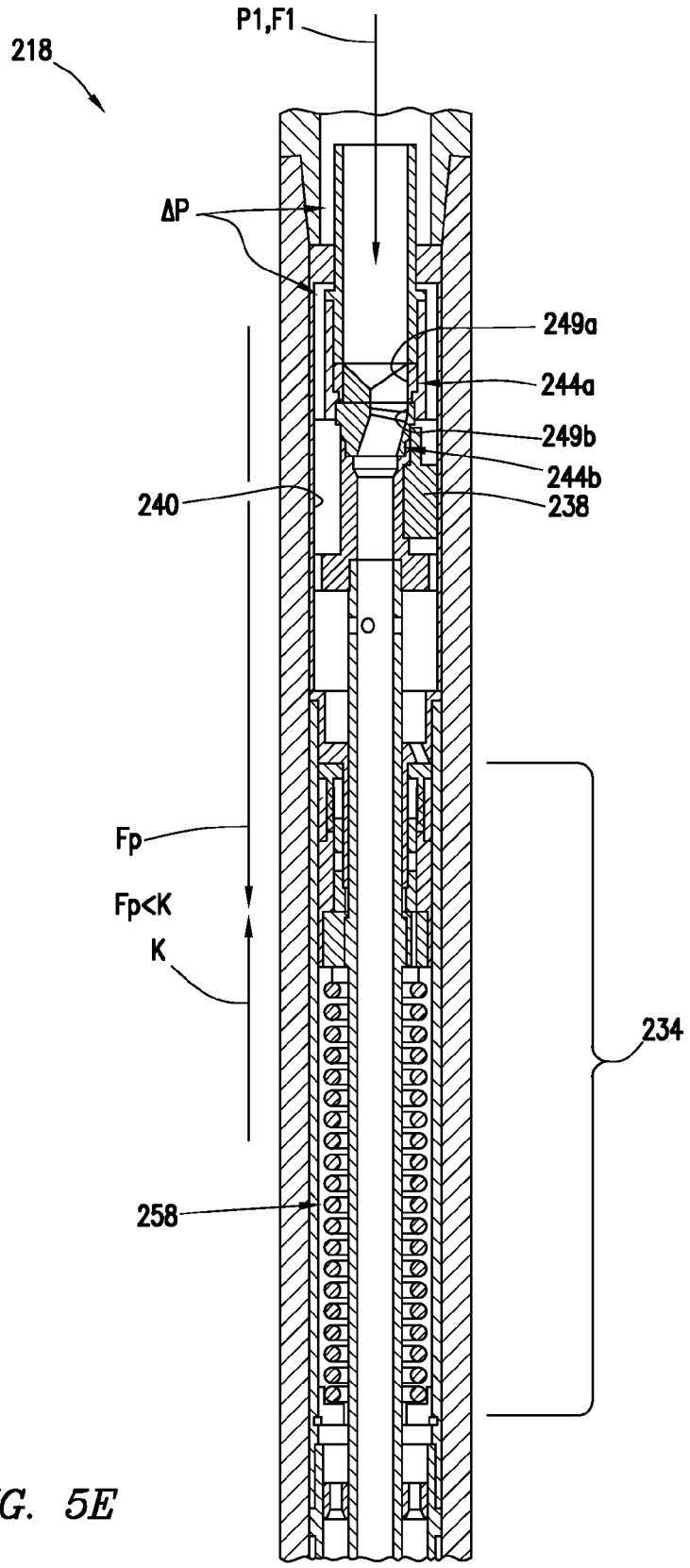

FIG. 5E shows the activation assembly 218 upon completion of the activation sequence at ΔP, F1, P1, and Fp. The entire sequence can be repeated multiple times providing unlimited tool position switching. Due to low pressure differential, force Fp against spring force K changes and the indexer 234 is notched into its new position powered and retained by the return spring 258. The indexer 234 is now switched to a new position. The drop in pressure to P1 provides pressure signal detectable at the surface to indicate that the switching sequence is complete.

Figure 6:
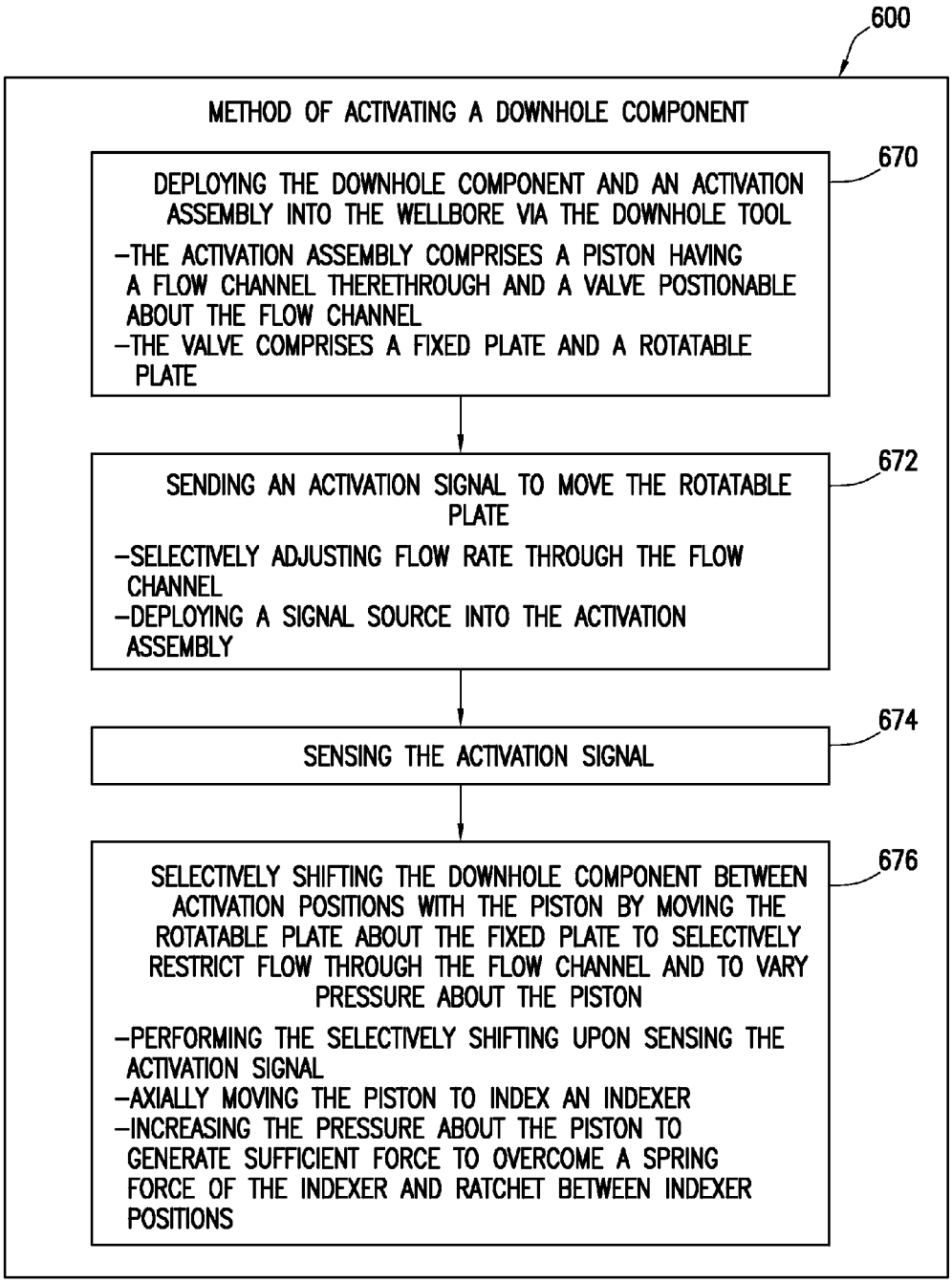
FIG. 6 depicts a method of activating a downhole component.

FIG. 6 shows a method 600 of activating a downhole component of a downhole tool, such as shown in FIG. 1. The method involves 670 deploying the downhole component and an activation assembly into the wellbore via the downhole tool. The activation assembly includes a piston having a flow channel therethrough and a valve positionable about the flow channel. The valve includes a fixed plate and a rotatable plate.

The method may also involve 672 sending an activation signal to move the rotatable plate and 674 sensing the activation signal. The sending 672 may be performed by selectively adjusting flow rate through the flow channel and/or by deploying a signal source into the activation assembly.

The method also involve 676 selectively shifting the downhole component between activation positions with the piston by moving the rotatable plate about the fixed plate to selectively restrict flow through the flow channel and to vary pressure about the piston. The selectively shifting 676 may involve performing the selectively shifting upon sensing the activation signal, axially moving the piston to index an indexer, and/or increasing the pressure about the piston to generate sufficient force to overcome a spring force of the indexer and ratchet between indexer positions.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more activation assemblies may be provided with one or more features as provided herein and connected about the drilling system.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A downhole activation assembly for activating a downhole component of a downhole tool positionable in a wellbore penetrating a subterranean formation, the activation assembly comprising:

a housing operatively connectable to the downhole tool;

a piston slidably positionable in the housing with a chamber defined therebetween, the piston having a flow channel therethrough; and a valve positionable about the flow channel of the piston, the valve comprising a fixed plate and a rotatable plate, the rotatable plate movable about the fixed plate to define a variable bore to selectively restrict flow through the flow channel and to vary pressure about the piston whereby the piston is selectively moved to shift the downhole component between activation positions.

2. The activation assembly of claim 1, wherein the fixed plate has a fixed offset bore.

3. The activation assembly of claim 2, wherein the rotatable plate has a movable offset bore positionable relative to the fixed offset bore.

4. The activation assembly of claim 1, wherein the variable bore defines a variable cross-sectional flow area.

5. The activation assembly of claim 1, wherein the fixed plate has a funnel shape and the rotatable plate has an inverted funnel shape.

6. The activation assembly of claim 1, wherein the piston comprises an uphole portion and a downhole portion with the valve therebetween.

7. The activation assembly of claim 1, further comprising a spring loaded indexing sleeve operatively connecting the piston to the downhole component.

8. The activation assembly of claim 7, wherein the sleeve has ports therethrough to permit passage of fluid between the flow channel and the chamber.

9. The activation assembly of claim 1, further comprising a sensor to detect an activation signal.

10. The activation assembly of claim 9, further comprising a signal source deployable into the activation assembly to send the activation signal.

11. The activation assembly of claim 9, wherein the activation signal comprises a change in flow of the fluid.

12. The activation assembly of claim 1, further comprising a motor to selectively move the rotatable plate.

13. The activation assembly of claim 12, further comprising a sensor to activate the motor upon detection of an activation signal.

14. The activation assembly of claim 1, further comprising centralizers positionable about the housing.

15. The downhole tool of claim 1, wherein the downhole component comprises at least one of an indexer, a stabilizer, and a reamer.

16. The downhole tool of claim 1, further comprising a surface controller.

17. The downhole tool of claim 1, wherein the bottom hole assembly further comprises a downhole controller.

18. A downhole tool positionable in a wellbore penetrating a subterranean formation, the downhole tool comprising:

a conveyance;

a bottom hole assembly deployable into the wellbore by the conveyance, the bottom hole assembly carrying a downhole component;

a downhole activation assembly for activating the downhole component, the activation assembly positionable about the bottom hole assembly, the activation assembly comprising:

a housing operatively connectable to the bottom hole assembly;

a piston slidably positionable in the housing with a chamber defined therebetween, the piston having a flow channel therethrough; and a valve positionable about the flow channel of the piston, the valve comprising a fixed plate and a rotatable plate, the rotatable plate movable about the fixed plate to define a variable bore to selectively restrict flow through the flow channel and to vary pressure about the piston whereby the piston is selectively moved to shift the downhole component between activation positions.

19. The downhole tool of claim 18, wherein the conveyance is a drill string fluidly connectable to a mud pit to pass fluid through the activation assembly.

20. The downhole tool of claim 19, further comprising a pump to selectively pass the fluid from the mud pit to the activation assembly.

21. The downhole tool of claim 19, further comprising a transducer to measure pressure of the fluid.

22. A method of activating a downhole component of a downhole tool positionable in a wellbore penetrating a subterranean formation, the method comprising:

deploying the downhole component and an activation assembly into the wellbore via the downhole tool, the activation assembly comprising a piston having a flow channel therethrough and a valve positionable about the flow channel, the valve comprising a fixed plate and a rotatable plate; and selectively shifting the downhole component between activation positions with the piston by moving the rotatable plate about the fixed plate to selectively restrict flow through the flow channel and to vary pressure about the piston.

23. The method of claim 22, further comprising sending an activation signal to move the rotatable plate.

24. The method of claim 23, further comprising sensing the activation signal.

25. The method of claim 23, wherein the sending comprises selectively adjusting flow rate through the flow channel.

26. The method of claim 23, further comprising deploying a signal source into the activation assembly and performing the selectively shifting upon sensing the activation signal.

27. The method of claim 22, wherein the selectively shifting comprises axially moving the piston to index an indexer.

28. The method of claim 27, wherein the selectively shifting comprises increasing pressure about the piston to generate sufficient force to overcome a spring force of the indexer and ratchet between indexer positions.

* * * * *